United States Patent [19]

Terui

[11] Patent Number: 4,496,330

[45] Date of Patent: Jan. 29, 1985

[54] MINIATURE TOY VEHICLE ASSEMBLY

[75] Inventor: Masumi Terui, Matsudo, Japan

[73] Assignee: Takara Co., Ltd., Tokyo, Japan

[21] Appl. No.: 476,622

[22] Filed: Mar. 18, 1983

[30] Foreign Application Priority Data

Dec. 29, 1982 [JP] Japan ..... 57-201732[U]

[51] Int. Cl.[3] ..... A63H 29/00

[52] U.S. Cl. ..... 446/464; 446/457

[58] Field of Search ..... 46/206, 209, 201, 211, 46/202, 208

[56] References Cited

U.S. PATENT DOCUMENTS 4,300,308 11/1981 Ikeda ..... 46/206

4,329,810 5/1982 Terui ..... 46/206

FOREIGN PATENT DOCUMENTS 1557404 12/1979 United Kingdom ..... 46/206

*Primary Examiner*—Mickey Yu

*Attorney, Agent, or Firm*—Jackson, Jones & Price

[57] ABSTRACT

A powered miniature toy vehicle having: an upper body member, a lower frame member of approximately 50 mm in length, a front wheel and axle assembly, a rear wheel and axle assembly, and a spring motor assembly. The ratio of the length of the motor assembly to the length of the lower frame member is approximately 0.5 and is approximately equal to the ratio of the total weight of the front wheel assembly, the rear wheel assembly and the motor assembly to the overall weight of the toy vehicle.

19 Claims, 8 Drawing Figures

MINIATURE TOY VEHICLE ASSEMBLY

BACKGROUND OF THE INVENTION

The present invention relates to a miniature toy vehicle assembly which comprises a vehicle housing molded of a plastic resin having an overall length of about 5 cm, and a motor assembly having a spring-powered prime mover mounted on the vehicle housing, and which has an overall weight of about 10 g.

Since such a miniature toy car has a large spring power when compared with the overall weight, the car can be propelled over a long distance at high speed. Moreover, by making the best use of its large power, it is possible for a child to enjoy a wide variety of games with the car. For example, if the car is made to collide with an obstacle, its course will be changed to an unexpected direction by means of the reaction force of the collision, or the car can be jumped by means of a jump.

Such a course change by means of the reaction force of a collision is remarkably effected by the fact that the car body rebounds from the obstacle by the reaction applied thereto and the front wheels thereof are lifted slightly off the support surface, i.e., the ground. In other words, it is considered that the course change is caused by a reduction in the lateral resistance due to the lift-off of the front wheels, the unbalance between the right and left rear wheels, the lateral component of the reaction force produced by the collision, and so forth. Accordingly, if the car is smaller in overall length, is more compact and lightweight, and has a construction that allows the front wheels to lift off more easily, it is possible to enjoy a toy vehicle with a more varied change of course.

On the other hand, the fact that the car is lightweight and compact is a disadvantage when enjoying the amusing running of the car, so much so that the interest of the play is reduced, since when the car is made to collide against an obstacle so that its course is changed to an unexpected direction by means of the reaction force as a result of the collision, the car may undesirably be made to roll over by the reaction force alone, or since the car cannot land stably after a jump and moreover the car can easily roll over even during normal running when it only slightly touches something, or it encounters unevenness in the support surface while running.

Accordingly, the toy industry demands a continued infusion of new toy concepts and is still receptive to new and novel toy vehicle designs to entertain and elicit the interest of children.

SUMMARY OF THE INVENTION

The present invention provides a miniature toy vehicle assembly that comprises a plastic resin housing member including an upper body shell and a lower frame member, a front wheel assembly attached to the housing member and including a front axle and a pair of front wheels, a rear wheel assembly attached to the housing member and including a rear axle and a pair of rear wheels, and a motor assembly attached to the housing member and having a spring-powered prime mover driving the rear axle of the rear wheel assembly.

The motor assembly according to the invention is attached to a substantially central part of the upper surface of the lower frame member. The ratio (l/L) of the length (l) of the motor assembly to the length (L) of the lower frame member is about 0.5.

The front axle is rotatably supported in the vicinity of the longitudinal front end of the motor assembly. The distance between the front axle and the rear axle is within the range of the length (l) of the motor assembly.

The front axle and the rear axle are attached to the housing member so that when the miniature toy vehicle assembly is placed on a flat support surface, the plane including the front axle and the rear axle will intersect the flat support surface in front of the front axle at a predetermined angle ($\theta$).

The relationship between the total weight (w) of the front wheel assembly, the rear wheel assembly, and the motor assembly, and the overall weight (W) of the miniature toy vehicle assembly is: $w/W > 0.5$.

The features of the present invention which are believed to be novel are set forth with particularity in the appended claims. The present invention, both as to its organization and manner of operation, together with further objects and advantages thereof, may best be understood by reference to the following description, taken in connection with the accompanying drawings.

DETAILED DESCRIPTION OF THE PREFERRED EMBODIMENTS

Figure 1:
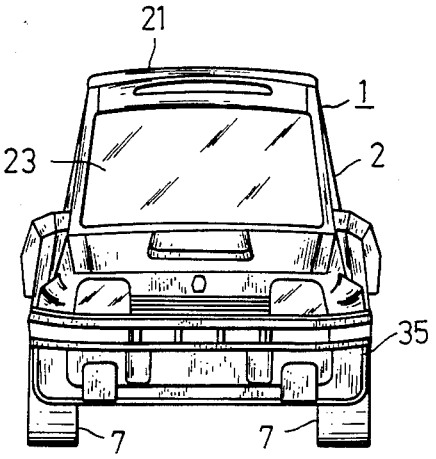
FIG. 1 is a front elevation of a miniature toy vehicle assembly in accordance with a preferred embodiment of the present invention.
Figure 2:
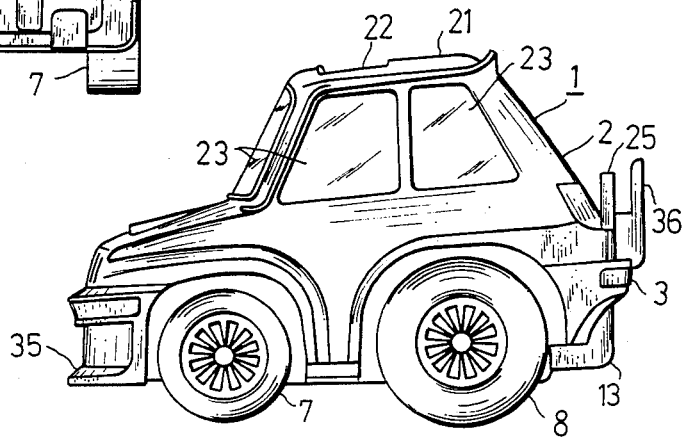
FIG. 2 is a side elevation of the miniature toy vehicle assembly of FIG. 1.
Figure 3:
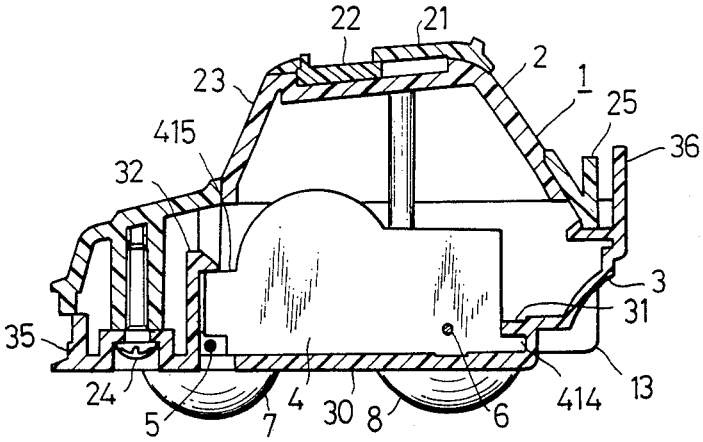
FIG. 3 is a sectioned side elevation of the vehicle housing of the miniature toy vehicle assembly of FIG. 1.
Figure 4:
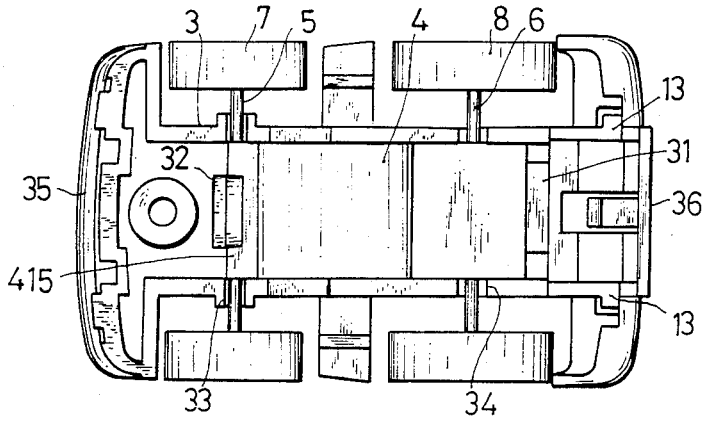
FIG. 4 is a plan view of the miniature toy vehicle assembly of FIG. 1, with the upper body shell thereof removed.

The following description is provided to enable any person skilled in the toy industry to make and use the present invention and sets forth the best modes contemplated by the inventor for carrying out his invention. Various modifications, however, will remain readily apparent to those skilled in the art, since the generic principles of the present invention have been defined herein specifically to provide a novel miniature toy vehicle assembly.

A primary object of the present invention is the provision of a miniature toy vehicle assembly having a highly stable running performance despite its compact and lightweight structure, which is easily capable of performing a jump, course change and the like as well as being able to move stably in these various manoeuvers as well as in normal running, by, in particular, enabling the front wheels thereof to be lifted off the support surface and returned thereto.

Referring now to FIGS. 1 thru 4 of the drawings, a toy vehicle assembly in accordance with a preferred embodiment of the present invention shown in these figures comprises a vehicle housing 1 constituted by an upper body shell 2 and a lower frame member 3, a self-contained motor assembly mounted on the vehicle housing 1, a front axle 5 and a rear axle 6 attached to the lower frame member 3 and the motor assembly 4, respectively, and front wheels 7 and rear wheels 8 attached to the front axle 5 and the rear axle 6, respectively. The toy vehicle assembly in accordance with the embodiment has an total weight of 10.5 g.

The vehicle housing 1 is made of a plastic resin, has an overall length of about 50 mm, a width of about 30 mm and a height of 30 mm. The weight of the upper body shell 2 is 3 g and that of the lower frame member is 1.5 g, totalling 4.5 g. The upper body shell 2 and the lower frame member 3 are secured to each other by means of a screw 24.

The upper body shell 2 is designed so that the external appearance thereof simulates a real racing car. In this embodiment, a roof 21 is provided with a sunroof 22, and each of the window portions is fitted with a window member 23 made of a plastic resin to look like window glass.

Figure 5:
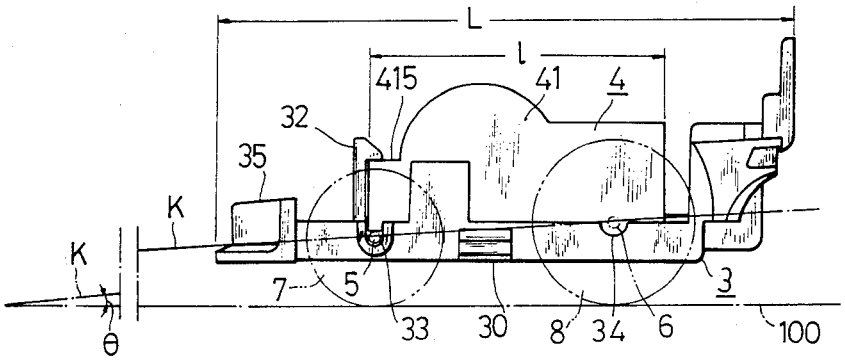
FIG. 5 is a side elevation of the miniature toy vehicle assembly of FIG. 1 with the body and wheels thereof removed.

The lower frame member 3, having a substantially L-shaped cross sectional configuration, is formed so that the self-contained motor assembly 4, described later, can be mounted onto the central part of its base surface 30. The lower frame member 3 has a retaining tab 31 and a retaining hook 32 provided to the rear and front of the self-contained motor assembly 4, respectively. Moreover, as shown in FIG. 5, a bearing 33 rotatably supporting the front axle 5 is provided in the vicinity of the retaining hook 32, and a notch 34 is provided slightly behind the central part of the lower frame member 3, corresponding to the rear axle 6. A bumper 35 is provided at the front end of the lower frame member 3, while a bracket 36 is provided at the rear end, projecting upward and acting as a number plate. The bracket 36 is arranged so as to face a vertical member 25 (in this embodiment, a vertical piece 25 is provided) provided at the rear end of the upper body shell 2 with a predetermined distance therebetween so that a weighted member such as a coin of monetary value, e.g., a penny or nickel, can be clamped between the bracket 36 and the vertical member 25.

Figure 7:
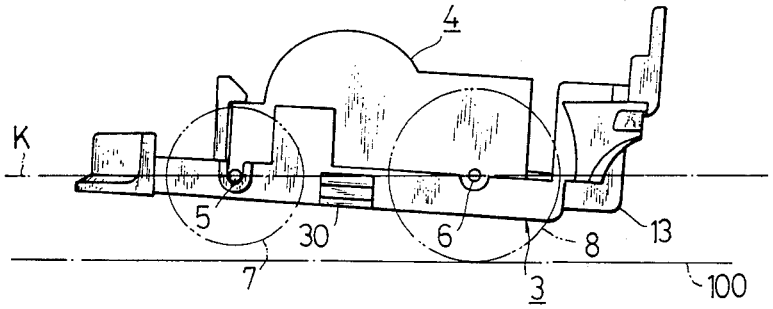
FIG. 7 is a side elevation of the miniature toy vehicle assembly of FIG. 1 with the body and the wheels thereof removed, illustrating the way in which the front wheels thereof lift off.

A guide member or portion 13 forms a curvilinear surface at the bottom of the bracket 36. The guide member 13 is configured to contact and slide on a support surface 100 (FIGS. 5 and 7) when the front wheels 7 are lifted off the support surface 100. The guide member 13 is positioned to support the miniature toy vehicle when it rotates about the rear axle 6. Accordingly, the toy, when propelled forward, provides an impression of high speed acceleration with its front wheel assembly being lifted off the support surface 100 as a result of the weight of the weighted member.

Figure 6:
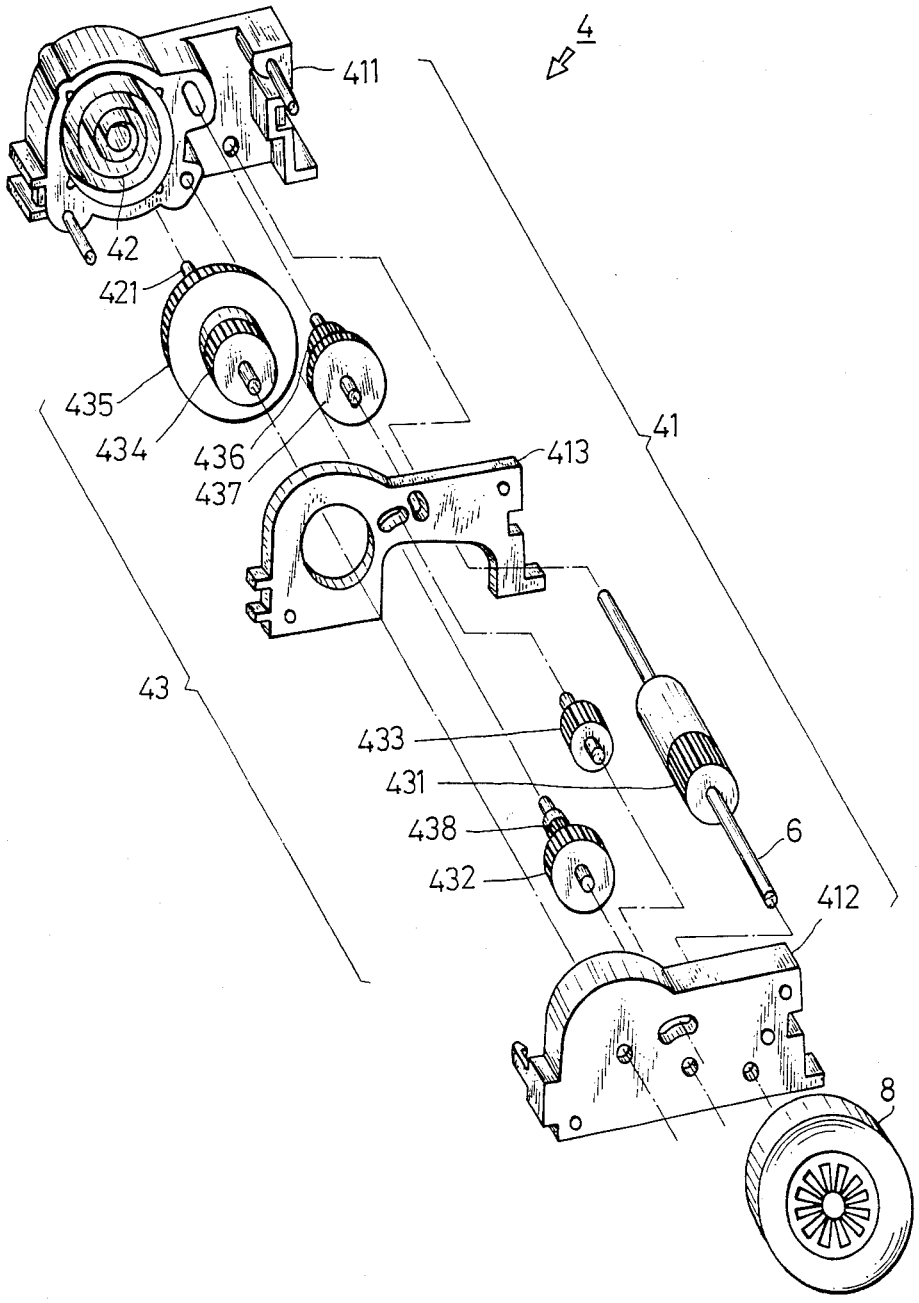
FIG. 6 is an exploded perspective view of an example of a motor assembly of the miniature toy vehicle assembly of FIG. 1.

The motor assembly 4 is formed by providing a spring 42 and a gear train 43 for transmitting power in a motor housing 41. Referring now to FIG. 6, showing an example of the motor assembly 4, the motor housing 41 comprises side shells 411, 412 and an intermediate plate 413 clamped therebetween and is made of a plastic resin. The motor housing 41 accommodates the spring 42 and the gear train 43. The gear train 43 has a winding system, i.e., a system for storing energy in the spring 42, and a driving system, i.e., a system for driving an output shaft, thereby allowing power to be reciprocally transmitted between the spring 42 and the rear axle 6. The gear train 43 is formed so that it is lightweight by employing a plastic resin with a modulus of, for example, 0.3. The thus formed motor assembly 4 of this embodiment is constructed so as to have a weight of about 3 g, exclusive of the rear axle 6.

The winding system of the gear train 43 i.e., the system for storing energy in the spring 42, comprises a pinion 431 secured to the rear axle 6 attached to the housing 41, a first spur gear 432 constantly engaging the pinion 431, a winding pinion 433 engaging the spur gear 432, and a small gear wheel 434 secured to a spring shaft 421 and engaging the pinion 433. The numbers of teeth of these gears are, for example, 10, 18, 10 and 18, respectively, in the engagement order. The winding pinion 433 is movable born so that it engages the spur gear 432 only during the winding-up mode of operation.

The driving system, i.e., the system for driving an output shaft, comprises a large gear wheel 435 secured to the spring shaft 421, a driving pinion 436 engaging the large gear wheel 435, a second spur gear 437 provided integrally with the pinion 436 and engaging a pinion 438 provided integrally with the first spur gear 432. The numbers of teeth of these gear wheels are, for example, 42, 9, 21 and 8, respectively, in the engagement order. The driving pinion 436 is movably born so as to engage with the large gear wheel 435 only during the driving of the toy car. It must be noted that the above first spur gear 432 and the pinion 431 function as gears in the driving system.

The speed ratio of the rear axle 6 to the spring shaft 421 of the above gear train 43 is 1.8 for the winding system and 22.05 for the driving system. Therefore, a 1.8 revolution of the rear axle 6 winds the spring 42 one revolution, while unwinding the spring 42 one revolution rotates the rear axle 6 to be rotated 22.05 times. Accordingly, a sufficiently large power can be stored by a short retreat distance, or backward movement of the toy car and high-speed long-distance running is made possible by releasing the power little by little.

The ratio l/L of length l of the motor assembly 4 to the length L of the lower frame member 3 is set to be about 0.5. In this embodiment, L is 48 mm, and l is 25 mm, and hence l/L is 0.52. The motor assembly 4 is mounted in the center of the bottom surface 30 of the lower frame member 3 and is secured by engaging a retaining projection 414 formed at the rear end of the motor housing 41, with the retaining tab 31, as well as engaging a step 415 formed at the front end of the motor housing 41 by the retaining hook 32.

The front axle 5 has the front wheels 7 attached to the right and left ends thereof, and is supported horizontally by the bearing 33 of the lower frame member 3 before the motor assembly 4 is mounted. The motor assembly 4 is then attached, covering the front axle 5 with the front end of the motor housing 41, so that the front axle 5 is indirectly rotatably supported by the motor assembly 4. Needless to say, however, the front axle 5 could be attached directly to the motor housing 41 of the motor assembly 4, or the front axle 5 could be attached directly to the lower frame member 3. The distance between the front wheels 7 attached to the front axle 5 is about 24 mm in this embodiment.

The rear axle 6, as described above, has the pinion 439 secured to the central part thereof and is attached so that it is supported horizontally by the motor housing 41, and it has the rear wheels 8 attached to both ends thereof. Accordingly, the rear axle 6 is directly and rotatably supported by the motor assembly 4 and is attached to the lower frame member 3 together with the motor assembly 4. It must be noted that the distance between the rear wheels 8 attached to the rear axle 6 is about 24 mm in this embodiment.

The distance between the front axle 5 and the rear axle 6 is set to be within the range of the length l of the motor assembly 4. In this embodiment, the distance between the two axles is 20 mm, which is less than l (25 mm). Accordingly, the driving system comprising the front and rear axles 5, 6 with the wheels 7, 8 and the motor assembly 4 is mounted so as to be concentrated at a substantially central portion of the lower frame member 3.

The weight w of the driving system is set so that the ratio of the weight w to the overall weight W of the car body including the driving system will be larger than 0.5, i.e., $w/W>0.5$. In the embodiment, the weight w of the driving system is about 6 g, which is the sum of the total weight, 1.2 g, of the front wheels 7 and the front axle 5, the total weight, 1.9 g, of the rear wheels 8 and the rear axle 6, and the weight, 3 g, of the motor assembly 4. On the other hand, the overall weight W of the car body is about 10.5 g, which is the sum of the above 6 g and the weight, 4.5 g, of the vehicle housing 1. Accordingly, the ratio, w/W, is 0.57, satisfying the above condition.

The front axle 5 and the rear axle 6 are attached to the housing member 1 so that when the miniature toy car is placed on a flat support surface 100, the plane K including the front axle 5 and the rear axle 6 will intersect the flat support surface 100 in front of the front axle 5 at a predetermined angle ($\theta$), as shown in FIG. 5. In other words, the height relationship between the mounting positions of the front axle 5 and the rear axle 6 is set so that the straight line K connecting the front axle 5 and the rear axle 6 intersects the flat support surface 100 in front of the front axle 5 at an angle $\theta$. Therefore, the rear axle 6 is attached at a position further from the surface 100 than is the front axle 5. On the other hand, the bottom surface 30 of the lower frame member 3 is maintained substantially parallel to the support surface 100. In consequence, the rear wheels 8 used have a larger diameter than the front wheels 7. In this embodiment, the diameters of the front wheels 7 and the rear wheels 8 are 11 mm and 14 mm, respectively.

The angle $\theta$ is represented by:

$$d \sin \theta = \tfrac{1}{2}(a_2 - a_1)$$

$$\theta = \sin^{-1}\left(\frac{a_2 - a_1}{2d}\right)$$

where d is the distance between the front axle 5 and the rear axle 6; $a_1$ the diameter of the front wheels 7; and $a_2$ the diameter of the rear wheels 8.

If the following numerical values are substituted for d, $a_2$ and $a_1$ in the above formula to obtain $\theta$, i.e., $d=20$ mm, $a_2=14$ mm and $a_1=11$ mm, the angle $\theta$ is determined to be about 4 degrees in this embodiment.

The operation of the miniature toy car assembly in accordance with the embodiment described above will now be explained.

To propel the miniature toy car assembly in accordance with the embodiment, the upper body shell 2 is first held with the fingers, and the car body is pushed backward in such a manner that the rear wheels 8 are rubbed against the support surface thereby storing energy in the spring 42 of the motor assembly 4. Removing the hand from the upper body shell 2 allows the rear wheels 8 to be driven by means of the power from the spring 42, so that the car body is propelled forward. If the car body is allowed to run as it is, the car body travels in a straight line at high speed. It is also possible to play with the car by changing the course of the car body by means of a reaction force produced by making the car body collide against a suitable obstacle. Furthermore, it is possible to jump the car body by making it run over a jump.

In such various ways of running, the miniature toy car assembly of the invention is able to run stably due to the fact that the center of gravity thereof is at the central part of the car body. This is because the driving system comprising the front and rear axles 5, 6 with the wheels 7, 8, and the motor assembly 4 is concentrated at a substantially central part of the lower frame member 3 by making the length l of the motor assembly 4 about $\frac{1}{2}$ of the overall length L of the lower frame member 3, and by mounting the motor assembly 4 in the central part of the lower frame member 3 as well as attaching the front axle 5 and the rear axle 6 within the range of the length of the motor assembly 4, and because the weight w of the driving system is made to be not less than $\frac{1}{2}$ of the overall weight W of the car body. In addition, since the fact that the distance between the front and rear axles is small, as mentioned above, this means that the turning moment about the rear wheels is small, the car body is able to turn quickly, thereby increasing the course-change effect.

Moreover, in the present invention, the rear axle 6 is attached at a position higher than the front axle 5 so that the plane including the two axles, i.e., the straight line K connecting the axles, is inclined down toward the front and intersects the support surface 100 at the angle $\theta$. The moment N of the force making the front wheels 7 contact the support surface 100 is:

$$N = Fd \sin \phi \left(\phi = \frac{\pi}{2} + \theta\right)$$

$$= Fd \cos \theta$$

where d is the distance between the rear axle 6 and the front axle 5; and F is the force applied about the rear axle 6 as a fulcrum. Since the straight line K inclines forward, the angle $\theta$ decreases as the front wheels 7 lift off, and becomes zero when the straight line K is parallel to the support surface 100. If the angle $\theta$ is within this range, the action that causes the front wheels 7 to be lifted off is at a maximum when they are on the support surface 100 and decreases with the lift-off thereof. Consequently, the action that makes the front wheels 7 contact the support surface 100 increases in accordance with the lift-off thereof and becomes a maximum when the angle $\theta$ is zero, functioning as a force restraining the lifting-off action.

These actions permit the miniature toy car assembly of the present invention to display the following features. Namely, when the toy car collides with an obstacle, the front end thereof easily lifts off, the car can readily effect a rapid turn, and then the front end drops easily. Accordingly, even if the car is made to collide at a relatively low speed, it is possible to change the course thereof to an unexpected direction. On the other hand, in a collision at high speed, when the front wheels are rapidly brought into contact with the support surface, there is no possibility of the lateral rolling of the car, so that it is possible to enjoy watching the car turn rapidly to a different direction. In this embodiment, the distance between the right and left wheels attached to each of the front and rear axles is made to be larger than the distance between the axles. This, in cooperation with the above actions, facilitates the turning of the toy vehicle as well as increasing the running stability.

The above action that lifts the front wheels off the support surface at a collision is mainly caused by the reaction force as a result of the collision and the rotational reaction force of the spring. On the other hand, the action that brings the front wheels into contact with the support surface is principally caused by gravity applied to the front wheels. In the present invention, these actions function synergically, since at least half of the overall weight is placed at the center of the lower frame member, as described above.

It must be noted that if the inclination of the center line on the side of the upper body shell is made larger than the above angle $\theta$ as is in this embodiment, the rolling of the car body can be suppressed more effectively. Moreover, when the car body is moved backward in order to store energy in the spring, the fingers can more easily grasp the upper body shell, so that even infants can readily operate the toy vehicle.

As has been described, according to the present invention it is possible to propel a toy vehicle highly stably although it is compact and lightweight. Moreover, when the car collides against an obstacle, the car will not easily roll laterally. On the contrary, such a collision will use its reaction to increase the course change effect favorably. Accordingly, the present invention allows children to enjoy a wide variety of car-propelling games in addition to normal play with the toy vehicle.

Figure 8:
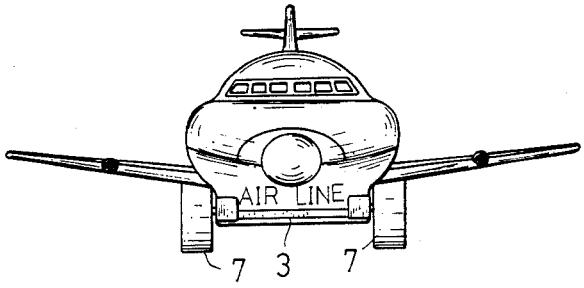
FIG. 8 is a front elevation of an airplane to which the present invention is applied.

Persons skilled in the toy field would be capable of modifying the various embodiments of the present invention within its generic teachings. In particular, in the above embodiment, the upper body shell of the housing member has a configuration which simulates a racing car. However, it will be readily understood that the upper body shell could have a configuration which simulates a airplane as shown in FIG. 8 or any other desired configuration. Since in such a case the constructions of the parts other than the upper body shell can be the same as those in the above embodiment, any detailed description thereof is unnecessary.

It will thus be seen that the objects set forth above, among those other objects made apparent from the preceding description, are efficiently attained and, since certain changes may be made in the above constructions without departing from the spirit and scope of the invention, it is intended that all matters contained in the above description or shown in the accompanying drawings shall be interpreted as illustrative and not in a limiting sense.

It is also to be understood that the following claims are intended to cover all of the generic and specific features of the invention herein described, and all statements of the scope of the invention, which, as a matter of language, might be said to fall therebetween.

What is claimed is:

1. A miniature toy vehicle assembly consisting of:

a plastic resin housing member including an upper body shell and a lower frame member;

a front wheel assembly attached to said housing member and including a front axle and a pair of front wheels;

a rear wheel assembly attached to said housing member and including a rear axle and a pair of rear wheels; and a motor assembly having a spring-powered prime mover attached to said housing member and adapted to drive the rear axle of said rear wheel assembly, wherein said motor assembly is fixed to a substantially central portion of the upper surface of said lower frame member, the ratio (l/L) of the length (l) of said motor assembly to the length (L) of said lower frame member being approximately 0.5;

said front axle is rotatably supported in the vicinity of the longitudinal front end of said motor assembly, the distance between said front axle and said rear axle being within the range of the length (l) of said motor assembly;

said front axle and said rear axle are attached to said housing member so that when said miniature toy vehicle assembly is placed on a flat support surface, the plane including said front axle and rear axle will intersect said flat support surface in front of said front axle at a predetermined angle ($\theta$); and the relationship between the total weight (w) of said front wheel assembly, rear wheel assembly and motor assembly, and the overall weight (W) of said miniature toy vehicle assembly is: $w/W > 0.5$.

2. A miniature toy vehicle assembly according to claim 1, wherein said spring-powered prime mover includes: a plastic resin housing member; an output shaft rotatably mounted onto the housing member; a spring member capable of selectively storing and releasing energy to drive the output shaft; and a plastic resin gear train assembly having a plurality of gears operatively connected to the spring member and the output shaft, said output shaft being employed as said rear axle.

3. A miniature toy vehicle assembly according to claim 2, wherein the length of said miniature toy vehicle assembly is approximately 50 mm, and the overall weight thereof is approximately 10 grams.

4. A miniature toy vehicle assembly according to claim 3, wherein said lower frame member has a substantially L-shaped cross sectional configuration and is provided with a retaining tab and a retaining hook thereon, by which said motor assembly is attached to said lower frame member.

5. A miniature toy vehicle assembly according to claim 4, wherein said housing member of said motor assembly has a projection formed at one end thereof and a step formed at the other end, whereby the projection is engaged with the retaining tab provided on said lower frame member and the step is engaged with the retaining hook provided on said lower frame member, thereby allowing said motor assembly to be attached to said lower frame member.

6. A miniature toy vehicle assembly according to claim 4, wherein the length (L) of said lower frame member is 48 mm, and the length (l) of said motor assembly is 25 mm.

7. A miniature toy vehicle assembly according to claim 4, wherein said lower frame member has in the vicinity of said retaining hook a bearing for rotatably supporting said front axle, and in the vicinity of said retaining tab notches for receiving said rear axle.

8. A miniature toy vehicle assembly according to claim 7, wherein said front axle is rotatably supported by being clamped between the bearing provided in said lower frame member and said motor assembly housing member attached to said lower frame member.

9. A miniature toy vehicle assembly according to claim 6, wherein the distance between said front axle and said rear axle is 20 mm.

10. A miniature toy vehicle assembly according to claim 3, wherein said rear axle is attached to said spring-powered prime mover housing member at a position higher than said front axle with respect to said flat support surface.

11. A miniature toy vehicle assembly according to claim 10, wherein the bottom surface of said lower frame member and said flat support surface are virtually parallel to each other.

12. A miniature toy vehicle assembly according to claim 11, wherein said rear wheels are larger in diameter than said front wheels.

13. A miniature toy vehicle assembly according to claim 12, wherein said predetermined angle ($\theta$) is 4 degrees.

14. A miniature toy vehicle assembly according to claim 3, wherein the total weight (w) of said front wheel assembly, rear wheel assembly and motor assembly is 6 grams, and the overall weight of said miniature toy vehicle assembly is 10.5 grams.

15. A miniature toy vehicle assembly according to claim 14, wherein said housing member has a length of approximately 50 mm, a width of approximately 30 mm and a height of approximately 30 mm, and said upper body shell and lower frame member have weights of 3 grams and 1.5 grams, respectively, and are connected together by a screw.

16. A miniature toy vehicle assembly according to claim 3, wherein the distance between said pair of wheels in each of said front wheel assembly and said rear wheel assembly is larger than the distance between said front axle and said rear axle.

17. A miniature toy vehicle assembly according to claim 3, wherein said upper body shell has a configuration which simulates real vehicle.

18. A miniature toy vehicle assembly capable of self propulsion across a support surface and having the ability to travel at relatively high speeds in a stable manner consisting of:

a lightweight plastic resin housing assembly including an upper body member and a lower frame member of approximately 50 mm in length;

a front wheel assembly operatively attached to the lower frame member including a pair of front wheels;

a rear wheel assembly operatively attached to the lower frame member including a pair of rear wheels of a diameter greater than the diameter of the front wheels of the front wheel assembly; and a motor assembly operatively attached to one of the front and rear wheel assemblies, the ratio of the length of the housing assembly to the length of the motor assembly being approximately equal to the ratio of the total weight of the front wheel assembly, of the rear wheel assembly and the motor assembly to the overall weight of the toy assembly.

19. The invention of claim 18 wherein the ratio is approximately 0.5.

* * * * *